US012735238B2

(12) United States Patent
Burgos Cruz et al.

(10) Patent No.: US 12,735,238 B2
(45) Date of Patent: Sep. 15, 2026

(54) CONTACT LENS BLISTER PACKAGE

(71) Applicant: CooperVision International Limited, Fareham (GB)

(72) Inventors: Jose A. Burgos Cruz, Coamo, PR (US); Lucas Sievens Figueroa, San Juan, PR (US); Robin Frith, Southampton (GB); Jaroslaw W. Orlik, Southampton (GB); Paul David Riggs, Southampton (GB); Kristin Waxmonsky, Rochester, NY (US)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 19/087,619

(22) Filed: Mar. 24, 2025

(65) Prior Publication Data

US 2025/0304347 A1 Oct. 2, 2025

Related U.S. Application Data

(60) Provisional application No. 63/571,176, filed on Mar. 28, 2024.

(51) Int. Cl.

| | |
|---|---|
| ***B65D 75/36*** | (2006.01) |
| ***A45C 11/04*** | (2006.01) |
| ***B65D 81/22*** | (2006.01) |

(52) U.S. Cl.

CPC ..... *B65D 75/367* (2013.01); *B65D 81/22* (2013.01); *B65D 2585/545* (2013.01)

(58) Field of Classification Search

CPC ..... B65D 75/367; B65D 81/22; B65D 2585/545; A45C 11/005

(Continued)

(56) References Cited

U.S. PATENT DOCUMENTS 6,568,533 B1 * 5/2003 Tanaka ..... B65D 75/5855 206/530
2003/0057111 A1 * 3/2003 Ichikawa ..... B65D 77/2032 206/210

(Continued)

FOREIGN PATENT DOCUMENTS

CN 104024122 A 9/2014
CN 220315941 U 1/2024

(Continued)

OTHER PUBLICATIONS

PCT Demand filed Dec. 5, 2025 in corresponding International Patent Application No. PCT/GB2025/050632 (38 pages).

(Continued)

*Primary Examiner* — Luan K Bui
(74) *Attorney, Agent, or Firm* — Kilyk & Bowersox, P.L.L.C.

(57) ABSTRACT

A blister package assembly 1 is disclosed. A seal member 10 affixed to the planar surface region 6 of each base member 4 to form a seal 12 and thereby contain a contact lens and a packaging solution in the cavity 8 of the base member 4. The seal 12 comprises a first seal region 14 extending around the perimeter of the cavity 8 of each base member 4; and one or more second seal region(s) 16, wherein each second seal region 16 connects the first seal regions 14 of a pair of adjacent base members 4. The length of the second seal region 16 is at least a third of the minimum width of the second seal region 16. A method of manufacturing such a blister package, and a sealing head for use in such a method is also disclosed.

23 Claims, 5 Drawing Sheets

(58) Field of Classification Search
USPC ..... 206/5.1
See application file for complete search history.

(56) References Cited

U.S. PATENT DOCUMENTS

| | | | | |
|---|---|---|---|---|
| 2008/0078681 | A1* | 4/2008 | Newman | B65D 73/005 29/428 |
| 2009/0200182 | A1 | 8/2009 | Post-Smith et al. | |
| 2014/0331602 | A1* | 11/2014 | Newman | B29C 66/8432 53/422 |
| 2015/0114851 | A1* | 4/2015 | English | B65D 75/326 53/431 |
| 2017/0165901 | A1* | 6/2017 | Fischer | B29C 66/8322 |
| 2019/0039798 | A1 | 2/2019 | Davis | |

FOREIGN PATENT DOCUMENTS

| | | | |
|---|---|---|---|
| EP | 2840927 | B1 | 11/2015 |
| KR | 10-2018-0110176 | A | 10/2018 |
| WO | 2013160667 | A1 | 10/2013 |
| WO | 2023007126 | A1 | 2/2023 |
| WO | 2023111941 | A1 | 6/2023 |
| WO | 2023233117 | A1 | 12/2023 |

OTHER PUBLICATIONS

Amended Claim Set filed Dec. 18, 2025 in corresponding International Patent Application No. PCT/GB2025/050632 (13 pages).
Communication issued in corresponding International Patent Application No. PCT/GB2025/050632 dated Dec. 19, 2025 (4 pages).
International Preliminary Report on Patentability issued in corresponding International Patent Application No. PCT/GB2025/050632 dated Jan. 12, 2026 (15 pages).
Search and Examination Report issued in corresponding United Kingdom Patent Application No. 2504335.7 dated Sep. 23, 2025 (10 pages).
International Search Report and Written Opinion issued in corresponding International Patent Application No. PCT/GB2025/050632 dated Jun. 10, 2025 (13 pages).

* cited by examiner

CONTACT LENS BLISTER PACKAGE

This application claims the benefit under 35 U.S.C. § 119(e) of prior U.S. Provisional Patent Application No. 63/571,176, filed Mar. 28, 2024, which is incorporated in its entirety by reference herein.

The present disclosure concerns blister packages for contact lenses, more particularly, but not exclusively, blister packages having a base member comprising a cavity in which an unworn contact lens is stored in a contact lens packaging solution; and a seal member affixed to the base member to seal the cavity.

BACKGROUND

Soft contact lenses, for example hydrogel and silicone hydrogel contact lenses, are stored in a contact lens packaging solution in order to keep them hydrated and in a useable condition. Contact lenses are typically individually packaged in a blister package. Blister packages provide a sterile and secure environment for unused contact lenses, allowing them to be transported and stored safely until such time as they are required by an end user. A conventional blister package comprises a base member made of a plastics material having a cavity formed therein and a seal member that is sealed to that base member to seal the cavity. Blister packages are typically arranged in rows (or strips) with, for example five or more, blister packages connected to each other. Contact lenses are typically packaged in the blister package in a manufacturing process that includes the steps of: placing the contact lens in the cavity of the base member, adding a volume of contact lens packaging solution to the cavity, sealing the cavity with a seal member thereby containing the lens and the solution within the packaging, and then autoclaving the sealed blister package in order to sterilize the contact lens and solution within the blister cavity. WO 2023/007126 (CooperVision International Limited) and WO 2023/233117 (CooperVision International Limited) are examples of contact lens blister packages.

It is desirable that blister packages be easy and convenient for a contact lens user to open. At the same time, it is important that the blister packages are sufficiently robust so as to withstand the manufacturing process and/or subsequent handling. It is also increasingly important to consider the environmental impact of blister packages, for example the amount of plastic materials used and/or the recyclability of the packages.

The present disclosure seeks to mitigate the above-mentioned problems. Alternatively or additionally, the present disclosure seeks to provide improved blister packages and/or methods of manufacturing such blister packages.

SUMMARY

In an aspect, the present disclosure provides a blister package assembly comprising:

at least two base members, each base member comprising (i) a cavity containing a contact lens in a contact lens packaging solution; and (ii) a planar surface region surrounding the cavity; and a seal member affixed to the planar surface region of each base member to form a seal and thereby contain the contact lens and the packaging solution in the cavity;

wherein for each pair of adjacent base members, the seal comprises:

for each base member, a first seal region extending around the perimeter of the cavity and extending from an inner edge of the seal, the first seal region having a substantially constant width, wherein the width of the first seal region is the minimum perpendicular distance between the inner edge of the seal and an opposing outer edge of the seal around the cavity, the first seal regions of the pair being spaced apart; and one or more second seal region(s), wherein each second seal region connects the first seal regions of the pair along a first axis;

each second seal region having a length, being the minimum extent of the second seal region between the first seal regions in a direction parallel to the first axis, and a width, being the extent of the seal in a direction perpendicular to the first axis, and wherein the length of the second seal region is at least a third of the minimum width of the second seal region.

In an aspect, the present disclosure provides a method of manufacturing a contact lens blister package assembly, the blister package assembly comprising at least two base members, each base member comprising a cavity holding a contact lens and contact lens packaging solution; and a planar surface region surrounding the cavity, the method comprising: affixing a seal member to each base member to form a seal and thereby contain the contact lens and the packaging solution in the cavity, wherein the step of affixing comprises pressing the seal member against the base members using a sealing head having a raised region, wherein heating of the raised region melts the base member to form the seal, the raised region comprising:

a plurality of first raised regions, the first raised regions being spaced apart along the sealing head; and one or more second raised regions; each second raised region connecting each pair of adjacent first raised regions; and wherein when the sealing head is pressing the seal member against the base member, each first raised region surrounds the cavity on one of the base members.

In an aspect, the present disclosure provides a sealing head for use in any other aspect.

In an aspect, the present disclosure provides a blister package assembly comprising:

at least two base members, each base member having a surface comprising a cavity containing a contact lens in a contact lens packaging solution, each base member being made of the thermoplastic material; and a seal member affixed to the surface of each base member to form a seal and thereby contain the contact lens and the packaging solution in the cavity;

wherein for each pair of adjacent base members, the seal member is fused to a melted region of the surface; said melted region extends between the base members of the pair to form one or more bridges of thermoplastic material; and wherein the sum of the minimum width of the bridge(s) is from 1 mm to 8 mm inclusive; and each bridge has a minimum length of 0.3 to 0.8 mm.

In one aspect of the disclosure, there is provided a method of manufacturing a contact lens blister package assembly comprising a plurality of base members, each base member being made of thermoplastic material, comprising:

a sealing head having a raised region heat sealing adjacent base members to a seal member, thereby forming a strip of interconnected blister packs each containing a contact lens in solution sealed within; and wherein the raised region comprises a bridge region that during heat sealing melts the thermoplastics material of the base members such that at least one bridge of the thermoplastics material extends between adjacent edges of the base members, partially along the length of the adjacent said edges, the or each bridge having a predetermined shape and size to thereby provide additional longitudinal rigidity to resist flexure of the strip of blister packs during packaging.

In one aspect of the disclosure there is provided a sealing head having a seal formation portion operable to heat seal adjacent base members of thermoformable plastics material to a seal member, thereby forming a strip of interconnected blister packs each containing a contact lens in solution sealed within;

the sealing head further comprising a bridge shaping portion operable during the heat sealing operation to further thermoform at least one bridge of the plastics material across a gap between adjacent edges of the blister packs, the or each bridge having a predetermined size to thereby provide additional longitudinal rigidity to control flexure of the strip of blister packs.

Optional but preferred features are set out in the dependent claims.

It will of course be appreciated that features described in relation to one aspect of the present disclosure may be incorporated into other aspects of the present disclosure. For example, the method of the disclosure may incorporate any of the features described with reference to the apparatus of the disclosure and vice versa.

DESCRIPTION OF THE DRAWINGS

Example embodiments will now be described, by way of example only, with reference to the accompanying schematic drawings, of which.

DETAILED DESCRIPTION

Figure 1:
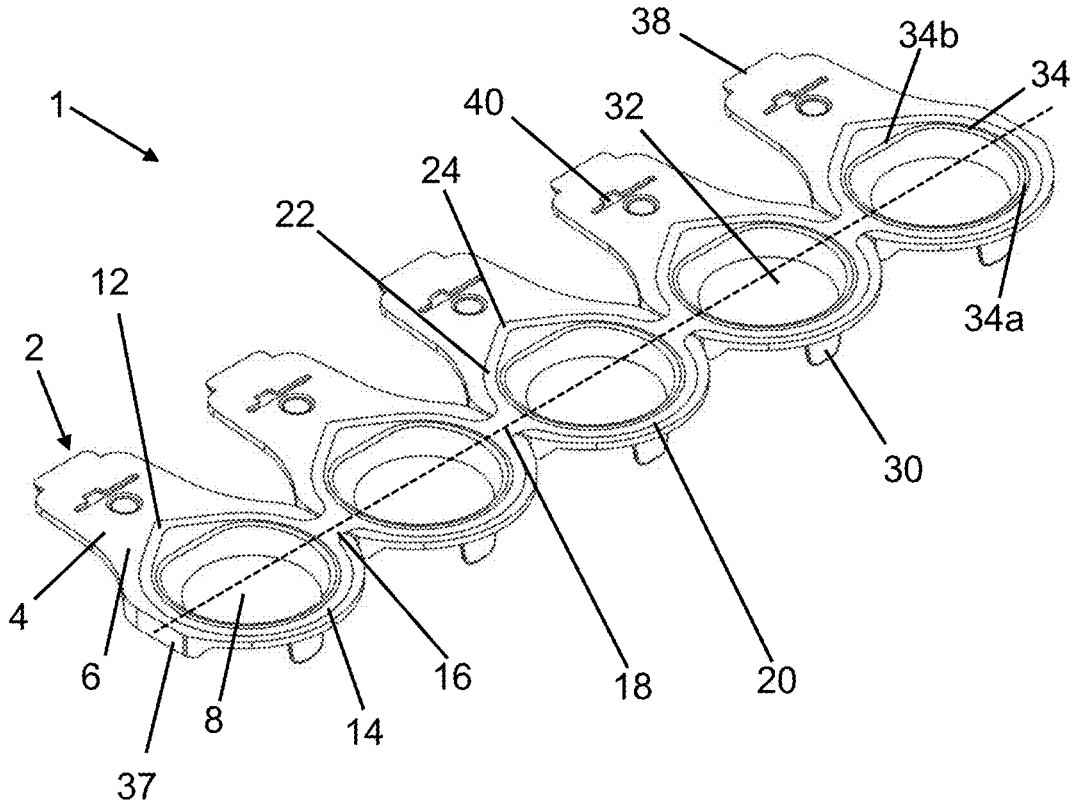
FIG. 1 shows a perspective view of a blister package strip 1 in accordance with a first example embodiment.
Figure 2:
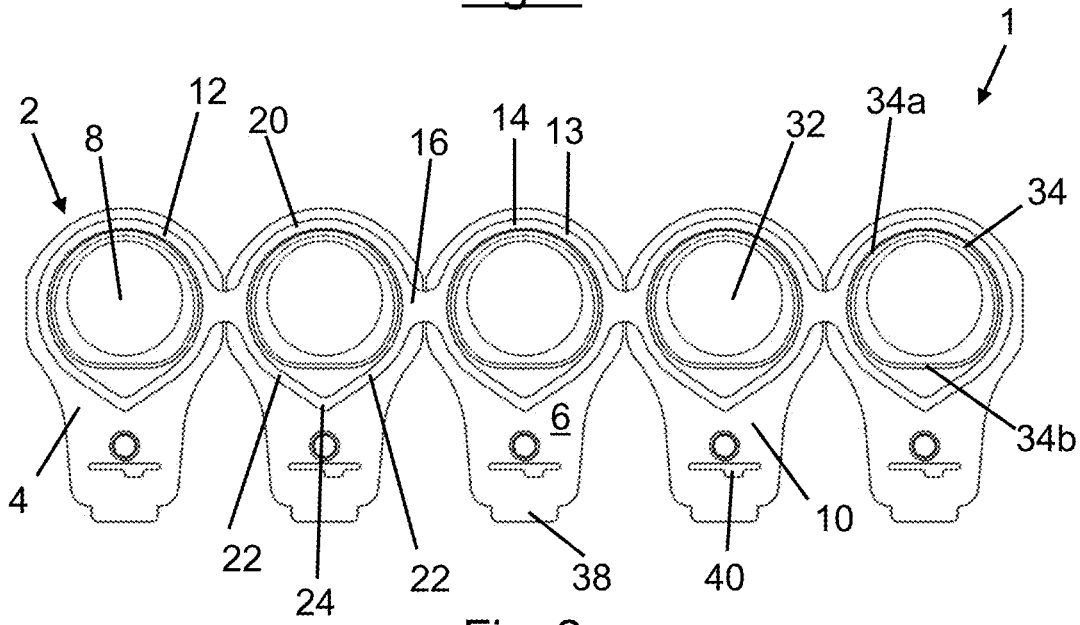
FIG. 2 shows a plan view of the top of the blister package strip 1 of FIG. 1.

According to an aspect of the disclosure, there may be provided a blister package assembly comprising at least two base members. It may be that each base member comprises (i) a cavity containing a contact lens in a contact lens packaging solution and/or (ii) a planar surface region surrounding the cavity. It may be that the blister package assembly comprises a seal member affixed to each of the base members, for example the planar surface region of each base member, to form a seal and thereby contain the contact lens and the packaging solution in the cavity. It may be that the seal comprises, for each base member, a first seal region extending around the perimeter of the cavity and extending from an inner edge of the seal, the first seal region having a substantially constant width. It may be that the width of the first seal region is the minimum perpendicular distance between the inner edge of the seal and an opposing outer edge of the seal around the cavity. It may be that each first seal region is spaced apart from any other the seal region. For example, it may be that the first seal regions of each pair of adjacent blister packages are spaced apart. It may be that for each pair of adjacent blister packages, the seal comprises at least one second seal region, each second seal region interconnecting (connecting or extending between) the first seal regions of the pair, for example along a first axis. It may be that each second seal region has a length, being the minimum extent of the second seal region between the first seal regions, for example in a direction parallel to and/or along the first axis. It may be that each second seal region has a width, being the extent of the seal in a direction perpendicular to the first axis. It may be that the length of the second seal region is at least a third of the minimum width of the second seal region.

Thus, the seals of blister package assemblies in accordance with the present disclosure may have one or more elongate bridges extending between regions of the seal that close off adjacent cavities of the assembly. Providing such elongate bridges may assist in providing a blister package that is easy for a user to open and/or to separate from an adjacent blister yet sufficiently robust and/or easy to handle during packaging processes, without the need to increase the amount of plastics material. For example, in comparison to the blister packages of WO 2023/007126 and WO 2023/233117, the second seal regions may provide additional rigidity to the blister package assembly without need to include more plastic material in the base member. This additional rigidity may assist with subsequent handling of the blister package assembly, for example during other manufacturing and/or packaging steps. Additionally or alternatively, in comparison with increasing the width of the regions that close off the cavity of the individual blister packages until they merge, the elongate bridges may provide additional rigidity while limiting the increase in force required to open the blister packages, and therefore assist in maintaining ease of use.

It may be that for each pair of adjacent base members a single second seal region extends between the first seal regions of the pair. It may be that the first axis extends between the first regions where the distance between the outer edges of the first regions is at a minimum. Having a single second seal region where the first regions are closest together may provide additional rigidity while keeping the increase in the area of the seal (and therefore the force required to open the blister package) as low as possible.

Thus, it may be that there is provided a blister package assembly comprising: at least two base members, each base member comprising a cavity containing a contact lens in a contact lens packaging solution; and a planar surface region surrounding the cavity; and a seal member affixed to the planar surface region of each base member to form a seal and thereby contain the contact lens and the packaging solution in the cavity; wherein for each pair of adjacent base members, a first axis extends from one cavity of the pair to the other cavity of the pair where the distance between the perimeter of the cavities is at a minimum; and for each base member of the pair, the seal comprises: a first seal region extending around the perimeter of the cavity and extending from an inner edge of the seal, the first seal region having a substantially constant width, wherein the width of the first seal region is the minimum perpendicular distance between the inner edge of the seal and an opposing outer edge of the seal around the cavity; and a second seal region, the second seal region extending from the first seal region to a side of the base member along the first axis in the direction of the other base member of the pair; the second seal region having a length, being the extent of the second seal region along the first axis, and a width, being the extent of the seal in a direction perpendicular to the first axis, and wherein the length is at least a third of the minimum width of the second seal region.

It will be appreciated, that the shape of the seal may equally be defined with reference to the shape on the seal member. Thus, there may be provided, a blister package assembly comprising: at least two base members, each base member comprising a cavity containing a contact lens in a contact lens packaging solution; and a planar surface region surrounding the cavity; and a seal member fused to the planar surface region of each base member to form a seal and thereby contain the contact lens and the packaging solution in the cavity, wherein the seal member comprises a melt region being a continuous region of the seal member that has been melted to provide the seal; wherein for each pair of adjacent base members, a first axis extends from one cavity of the pair to the other cavity of the pair where the distance between the perimeter of the cavities is at a minimum; and for each base member of the pair, the melt region comprises: a first melt region extending around the perimeter of the cavity and extending from an inner edge of the seal, the first melt region having a substantially constant width, wherein the width of the first melt region is the minimum perpendicular distance between the inner edge of the seal and an opposing outer edge of the seal around the cavity; and a second melt region, the second melt connecting (extending between) the first melt regions of the pair along the first axis; the second melt region having a length, being the minimum extent of the second melt region along the first axis, and a width, being the extent of the seal in a direction perpendicular to the first axis, and wherein the length is at least a third of the minimum width of the second melt region.

It will be appreciated that the melt region on the seal member generally corresponds to the seal. Accordingly, unless otherwise stated, descriptions of the shape and dimensions of the seal, first seal region and/or second seal region apply equally to the melt region, first melt region and/or second melt region respectively, and vice versa. Equally references to the 'first region' and 'second region' shall be understood as referring to the 'first seal region and/or the first melt region' and 'second seal region and/or second melt region' respectively, unless otherwise stated.

It may be that each blister package of the blister package assembly comprises a base member and a portion of the seal member sealed to and extending across the base member.

It may be that, around the cavity, for example around the majority or the whole of the perimeter of the cavity, the seal has an inner edge (being the edge of the seal closest to the cavity at any given location around the perimeter). It may be that, around the perimeter, for example around the majority of the perimeter, the seal has an outer edge (being the edge of the seal furthest from the cavity at any given location around the perimeter). The width of the first (seal and/or melt) region is defined as the minimum perpendicular distance between the inner edge of the seal and an opposing outer edge of the seal around the cavity. The first region then extends outwards from the inner edge of the seal by that distance, normal to the inner edge of the seal at any given location. It may be that the first region has an inner edge (being the edge of the region closest to the cavity at any given location around the perimeter). It may be that the inner edge of the first region is the inner edge of the seal. It may be that the first region has an outer edge (being the edge of the region furthest from the cavity at any given location around the perimeter). It may be that the outer edge of the first region is not always the outer edge of the seal.

It may be that the length of the second (seal and/or melt) region is the minimum distance between the outer edges of the first regions of two adjacent blister packages. Each second region extends between the first regions of two adjacent blister packages. Thus, each second region extends from the first region of one of said blister packages to the first region of the other of said blister packages.

Each first (seal and/or melt) region extends around the whole of the perimeter of the cavity. It may be that the or each first region has a width of from 1 mm to 2 mm inclusive, for example from 1.3 mm to 1.7 mm inclusive, for example a width of 1.5 mm. It may be that each first region has substantially the same width as any other first region of the assembly.

The width of the second (seal and/or melt) region is the extent of the seal in a direction perpendicular to the first axis. The second region may have an upper edge being the edge of the seal closest to the second end of the base member (see below) at any given location. The seal and/or second region may have a lower edge being the edge of the seal closest to the first end of the base member at any given location. Thus, the width of the second region may be defined as the perpendicular distance between the upper and lower edges of the seal. The width of the seal and/or second region may vary with distance along the first axis and/or the length of the second region. It may be that each second region is symmetrical along the first axis.

It may be that the minimum width of the second (seal and/or melt) region is located midway along the second region and/or equidistant from the first regions of adjacent blister packages.

It may be that the or each of second (seal and/or melt) regions has a minimum width of from 1 mm to 8 mm inclusive, for example from 1 mm to 2 mm inclusive, for example from 3 mm to 4 mm inclusive and/or from 7 mm to 8 mm inclusive. It will be appreciated that the minimum width is the shortest extent of the seal (i.e. distance between opposing edges of the seal in the second region) perpendicular to the first axis. It may be that each second region has substantially the same minimum width as any other second region of the assembly.

It may be that the minimum width of the or each second seal region is less than 3 times, for example less than 2.5 times, for example less than 2 times, the length of the second seal region. It may be that the minimum width of the or each second seal region is at least 0.5 mm, for example at least 1 mm.

It may be that the length of the or each second region is at least half the minimum width of the second region. For example, it may be that the length of the or each second region is at least 60%, for example at least 70%, for example at least 80%, for example at least 90% of the minimum width of the second region. It may be that the length of the or each second region is equal to or greater than the minimum width of the second region.

It may be that the length of the or each second region is at least 2 mm, for example at least 3 mm, for example at least 3.5 mm. It may be that the length of the or each second region is from 2 to 6 mm inclusive, for example from 3 mm to 5 mm inclusive, for example 3.5 mm. It may be that the length of the or each second region is no more than 20 mm, for example no more than 15 mm, for example no more than 10 mm.

It may be that the seal has a base depth, being the depth of the melted base member material at the seal. It may be that the base depth is the extent of the melted base member material in a direction perpendicular to the length and width of the seal and/or perpendicular to the planar surface region. It may be that the base depth is at least 0.5 mm, for example at least 0.75 mm. It may be that, at the edges of the base member, the base member is at least 50%, for example at least 75% of the thickness of the base member.

It will be appreciated that the seal comprises first seal regions and second seal regions. The seal may comprise further seal regions. Likewise, the melt region may comprise further melt regions. For example, the width of the seal may vary around the perimeter of the cavity, meaning that some regions of the seal are outside a first region defined by the minimum width of the seal around the cavity. However, it will be appreciated that the width of the second region is equal to the width of the seal and accordingly, the second region and the seal are coextensive in that region. The total surface area of any further seal and/or melt regions (if present) may be less than, for example at least half of, for example less than 20% of, for example less than 10% of, for example less than 5% of, the sum of the total surface area of the first regions and the total surface area of the second regions.

It may be that the base member has edges. It may be that the base member has sides. Each side may comprise the edges of the base member which are adjacent to another base member in the blister package assembly. The opposing sides of the base member may be equidistant from the cavity. The sides of the base member may be symmetrical along a centreline of the base member. It may be that the base member has ends. Each end may comprise the edges of the base member that extend between the sides and/or are substantially perpendicular to the sides. The end of the base member which is furthest from the centre of the cavity may be referred to as a first end. The end of the base member which is on the opposite side of the cavity to the first end may be referred to as a second end. The planar surface region may extend between the sides and the first and second ends of the base member. Thus, the top surface of the blister package may be substantially planar apart from the cavity. The planar surface region may extend across the majority of the top surface of the base member.

In the case that each pair of adjacent base members has a single second seal region, it may be that the first axis extends normal to the perimeter of each cavity at the point it intersects the perimeter. In the case that each pair of adjacent base members has a single second seal region, it may be that, for each pair of adjacent blister packages, the first axis extends from the cavity of one of the blister packages of the pair to the cavity of the other of the blister packages of the pair, where the distance between the cavities of the pair is is at a minimum. In that case, it may be that the first axis extends through the centre of each cavity of the blister package assembly.

The seal member may have a length (being its longest dimension) and a width. The seal member may be substantially planar. The seal member may have a thickness very much less than its width and length.

The blister package assembly may be a blister package strip, for example comprising at least five base members. It may be that the base members are arranged along the longitudinal axis (length) of the seal member, for example with their cavities in a line. The or each first axis may extend parallel to the longitudinal axis of the seal member. It may be that the blister packages are arranged side-by-side in the blister package assembly. It may be that each blister package assembly comprises a first end blister package and a second end blister package. It may be that each end blister package is only adjacent to a single blister package (i.e. only has another blister package on one side, being opposite sides for the first and second end blister packages). It may be that each end blister package has only one second seal region and/or the seal member associated with each end blister package has only one second melt region. It may be that each end blister package does not have a region extending away from the first (seal and/or melt) region along the first axis on the opposite side of the cavity to the adjacent blister package and/or extending towards the side of the base member which is at the end of the blister package assembly.

Excluding the seal and/or prior to sealing of the blister package, the base member of each blister package may be spaced apart from the base member of any other blister package, for example along the longitudinal axis. It may be that, excluding the seal and/or prior to sealing of the blister package, there is a gap between the base members of each pair of adjacent blister packages. For example, a gap of at least 0.3 mm, for example at least 0.4 mm, for example of at least 0.5 mm. The minimum distance between adjacent base members may be in the range of from 0.3 mm to 2 mm inclusive, for example from 0.5 mm to 2 mm inclusive. Seals in accordance with the present disclosure may find particular application in blister package assemblies having a gap between adjacent blister packages, as the elongate bridge can provide additional stiffness along the length of the seal member. It may be that the longitudinal axis of the gap (if present) between adjacent blister package extends perpendicular to the first axis and/or the second region. It may be that the second region extends across the gap.

It may be that the base members are initially separate, and it is melting of the base member to form the seal that causes base member material to extend across the gap and thereby allow the second region(s) to extend between the first regions. Thus, it may be that in the gap, the base member material of the second seal region is melted base member material. It may be that only melted base member material is present in the gap. In that case, the melt depth is equal to the thickness of the elongate bridge. In the gap, the melt depth/thickness, may be at least 0.5 mm, for example at least 0.75 mm. It may be that, in the gap, the melt depth is 100% of the thickness of the base member material. It may be that, in the gap, the melt depth is at least 50%, for example at least 75% of the thickness of the base member at the edges of the base member.

The seal member may comprise, for each base member, a pull tab for use in opening the blister package comprising the pull tab and the base member. It may be that the pull tab is a region of the seal member that is not affixed to the base member by the seal. It may be that the pull tab is sized and configured to be held between the thumb and forefinger of a user, such that the user may pull the pull tab in order to open the blister package and/or remove the seal member from the base member. The blister package may be configured such that the user pulls the pull tab along a first pull-axis in order to open the blister package and/or remove the seal member from the base member. The pull-axis may be perpendicular to the first axis along which the second (seal and/or melt) region extends. Thus, it may be that any additional rigidity provided by the second region is in a direction perpendicular to the direction of the force exerted by a user to open the blister package. This may reduce any increase in the force required to open the blister package as a consequence of the presence of the second region. It may be that the pull tab extends from an outer edge of the first region/seal around the cavity towards, for example to, the first end. It may be that the pull tab extends from the edge of the seal closest to the first end towards, for example to, the first end.

It may be that, for each pair of adjacent blister packages, the seal member comprises a series of perforations. It may be that each series of perforations extends perpendicular to the first axis and/or the second (seal and/or melt) region. It may be that each series of perforations extends across the second region(s), for example at a point equidistant from the first regions.

It may be that the minimum width of the seal (i.e. the minimum perpendicular distance between the inner edge of the seal and an opposing outer edge of the seal) around the cavity is located along the centre line of a blister package/base member, for example at 90 degrees to the second (seal and/or melt) region and/or the first axis of each pair. It may be the minimum width of the seal around the cavity is located on the opposite side of the cavity to the first end. The width of the seal may be substantially constant around the majority of the perimeter of the cavity. Other than at the second regions, the width of the seal may be substantially constant around the whole of the perimeter of the cavity.

The distance between the inner edge of the seal and the perimeter of the cavity may be substantially constant around the majority of, for example the whole of the cavity. The distance between the inner edge of the seal and the perimeter of the cavity may vary with respect to angle around the perimeter of the cavity, over a least part of, for example around the whole of the perimeter of the cavity. The distance between the inner edge of the seal and the perimeter of the cavity may vary only within a segment around the perimeter of the cavity, said segment having an angle around the centre of the cavity of from 60 to 130 degrees inclusive, for example from 80 to 110 degrees inclusive, for example from 85 to 95 degrees inclusive. The distance between the inner edge of the seal and the perimeter of the cavity may be greatest on the same side of the cavity as the first end. This may assist in making the blister package easy for a user to open.

The seal around the cavity and/or each first (seal and/or melt) region may comprise a (first) curved region, for example extending over an angle of at least 180 degrees, for example over at least 260 degrees, around the centre of the cavity. The curved region may be a (first) arcuate region (i.e. a region of constant radius with respect to the centre of the cavity). Thus, each first region may comprise a (first) arcuate region, for example extending over an angle of at least 180 degrees, for example at least 260 degrees, around the centre of the cavity. The curved and/or arcuate region may be concentric with the centre of the cavity. The arcuate region may extend around the opposite side of the cavity to the first end. It may be that the arcuate region extends over 360 degrees, i.e. the seal around the cavity and/or the seal region may be an annulus around, for example centred on the cavity.

The seal around the cavity and/or each first region may comprise a connecting region, the connecting region extending between the ends of the (first) curved or arcuate region such that the first region extends around the perimeter of the cavity. The connecting region may extend over less than 180 degrees, for example less 130 degrees, for example from 85 to 95 degrees inclusive, around the cavity.

It may be that the connecting region comprises or is a second arcuate region, for example having a different radius of curvature to the first arcuate region. Thus, the second arcuate region may extend over less than 180 degrees, for example less 130 degrees, for example from 85 to 95 degrees inclusive, around the cavity. It may be the connecting region comprises one or more straight regions, for example in which the seal and/or first region continues as a tangent to the curvature of the seal and/or first region at the end of the (first) curved and/or arcuate region. It may be that the first region, for example the connecting region, comprises two straight regions; one straight region being a tangent to the curvature of the seal/first region at a first end of the (first) curved/arcuate region and the other straight region being a tangent to the curvature of the seal/first region at a second end (e.g. the other end) of the (first) curved/arcuate region. It may be that the two straight regions meet such that the first region extends around the perimeter of the cavity.

It may be that the base member is made of a plastics material, for example a thermoplastic material. It may be that the base member comprises a top surface. For example, a top surface comprising the planar surface region. It may be that the cavity is a recess in the top surface. It may be that the base member comprises a bottom surface, being the surface on the opposite side of the base member to the top surface. It may that, apart from the cavity, the top surface of the base member is substantially planar. The intersection of the cavity and the planar surface region may be referred to as the perimeter of the cavity. The cavity may have a concave interior surface on the top side (i.e. the side of the top surface) of the base member and/or a convex exterior surface on the bottom side (i.e. the side of the bottom surface) of the base member. The cavity may be substantially hemispherical, substantially cylindrical and/or irregular in shape. The cavity may have a sidewall. The cavity may have a base.

The seal is where the seal member is affixed to the base members. It may be that the seal member is fused to the base member at the seal. For example, at the seal, a layer of plastic of the seal member is melted together with the material of the base member. It may be that the seal member is not affixed to the blister packages over the majority of the surface area of the seal member. It may be that the surface area of the seal is less than half of the surface area of the seal member and/or the surface area of the top surfaces of the blister packages to which the seal member is affixed.

The seal member is hermetically sealed to the base member at the seal. The seal member may comprise one or more layers of a plastics material, for example a thermoplastic material. The seal member may comprise one or layers of foil. Said layers may extend across the majority of, for example the whole of, the seal member. For example, the seal member may be a laminated structure including one or more layers of foil and one or more layers of a plastics material. The thickness of the seal member may be from 50 micrometers to 100 micrometers inclusive, for example from 60 micrometers to 70 micrometers inclusive. Suitable materials for the seal member can be obtained from AMCOR (Switzerland). It may be that, when affixed to the blister packages, the seal member covers the majority of, for example the whole of, the top surface of each base member. The seal member may have an area equal to the area of the top surface of the base member. The seal member may have an area greater than the area of the top surface of the base member. The seal member may have an area less than the area of the top surface of the base member. The seal member is joined to the base members to form a seal. It may be that the same seal member is affixed to all the blister packages of the blister package assembly.

It may be that the blister package assembly comprises a plurality of pairs of adjacent blister packages. It will be appreciated that each blister package may be in two pairs, for example one pair in which it is the left-most blister package, and another pair in which it is the right-most blister package.

The seal may be configured to provide a peel strength of less than 15 Newtons (N), for example a peel strength of from 4 N to 14 N inclusive, for example from 6 N to 11 N inclusive, for example from 8 N to ION inclusive. The peel strength can be measured using an INSTRON Model 5943 machine. For purposes of these measurements, the angle of pull is set at 45 degrees. The load cell of the machine is calibrated prior to testing the peel strength. Generally, the operating instructions are set by the manufacturer.

It may be that the minimum width of the second (seal and/or) region varies by less than 0.8 mm, for example less 0.75 mm, for example less than 0.5 mm between each pair of adjacent blister packages.

The contact lens contained in the blister package is preferably a soft contact lens. For example, a contact lens that has an equilibrium water content (EWC) from 10-90%. The contact lens may be a hydrogel contact lens. The contact lens may be a silicone hydrogel contact lens. The contact lens may be an unworn contact lens.

The base member may include two or more stabilising legs. The base member may include three or more stabilising legs. The stabilising legs may extend down from the bottom surface of the base member. The stabilising legs may be vertically aligned with the rim of the blister well. The stabilising legs may extend down from the bottom surface of the base member such that they extend out at least as far as, for example further than, the furthest extent of the cavity. The stabilising legs may extend out far enough to provide stability to the base member when it is placed upright on a flat surface. The stabilising legs may allow a reduction in the weight of the blister package to be achieved while still providing a blister package that is stable when placed upright on a flat surface without the handle formed by the flange having to serve as a stability support and whilst maintaining enough structural integrity to avoid problematic deformation and enough structural integrity to adequately protect a contact lens during transportation and storage.

The base member may include at least two side tabs. It may be that each side tab extending down from the top surface of the base member at an edge, for example a side, of the base member. The side tabs may be positioned on either side of the cavity, for example opposite each other. The side tabs may have a height (being the extent of the tab from the top surface) from 2 mm to 4 mm. The side tabs may have a height from 3 mm to 4 mm. The side tabs may have a height of 3 mm. The side tabs may have a height of 4 mm. The side tabs may have a length along the top surface of the flange of 6 mm to 10 mm. The side tabs may have a length along the top surface of the flange of 7 mm to 9.00 mm. The side tabs may have a length along the top surface of the flange of 8 mm. The side tabs may increase the structural integrity of the base member. The side tabs may reduce the likelihood of problematic deformation of the base member. The side tabs may increase the stability of the base member when it is placed upright on a flat surface. The side tabs may provide a gripping region.

It may be that a through-hole extends through the base member from the top surface to the bottom surface. It may be that the through-hole is located closer to an edge of the base member than to the centre of the cavity. For example, it may be that the through-hole is located closer to the first end of the base member, than to the centre of the cavity. The through-hole may be located at a distance of 10 mm to 30 mm from the centre of the cavity. The through-hole may be located at a distance of 20 mm from the centre of the cavity. The through-hole may have a maximum width (i.e. the greatest width in the case of a non-constant width), a maximum length (i.e. the greatest length in the case of a non-constant length) and a depth. The depth may be the extent of the through-hole through the base member. It may be that the maximum width and the maximum length are greater than the depth. It may be that the maximum width is less than the maximum length. It may be that the through-hole has a maximum width of from 0.5 mm to 1.5 mm inclusive, for example a width of from 0.9 mm to 1.1 mm inclusive. It may be that the through-hole has a maximum length of from 8 mm to 12 mm inclusive, for example from 9 mm to 11 mm inclusive. The through-hole may extend parallel (for example the length of the through-hole may be parallel) to the edge of the base member, for example the first end of the base member.

The first end of the base member may be shaped and configured to be received in the through-hole of a substantially identical base member. The first end and through-hole may be shaped and configured to interlock such that the first end can be inserted into a through-hole of a substantially identical base member by movement of the end relative to the through-hole in a first direction, and then the end and through-hole interlock to retain the end in the through-hole against movement in a second, opposite, direction. For example, the base member may be substantially planar at the first end apart from a protrusion extending from the top or bottom surface at said first end, said protrusion retaining the first end in the through-hole against movement in a second, opposite, direction. Each base member may be configured such that the first end of a first base member can be received in the through-hole of a second base member, while the first end of a third base member is received in the through-hole of the second base member and, optionally, while the first end of a further base member is received in the through-hold of the second base member. The base member may be so assembled when they have been used, i.e. when the seal member, contact lens and contact lens packaging solution have been removed. Thus, the base members can be connected together (after use) to form a used blister package assembly. This may facilitate recycling of the base members.

The cavity may hold a volume of contact lens packaging solution of from 0.4 mL to 1.6 mL inclusive, for example from 0.6 mL to 1.4 mL inclusive, for example from 0.8 mL to 1.2 mL inclusive. The cavity may have a depth (being the maximum extent perpendicular to the planar surface portion of from 5 mm to 8 mm inclusive, for example from 6 mm to 7 mm inclusive, for example 6 mm or 6.7 mm.

The base member may have a length (its longest dimension) from 40 mm to 50 mm inclusive, for example from 43 mm to 47 mm inclusive, for example the base member may have a length of 46 mm. The base member may have a thickness, being the distance between the top and bottom surfaces. The base member may have a width, being its extent perpendicular to the length and thickness. The base member may have and a width of from 25 mm to 35 mm inclusive, for example from 27 mm to 33 mm inclusive, for example from 28 mm to 30 mm inclusive, for example the base member may have a width of 29 mm. It may be that the base member has a weight of 0.72 g or less, for example from 0.40 g to 0.72 g inclusive, for example, a weight of 0.70 g, a weight of 0.72 g. It may be that the base member has a weight of less than 0.70 g, for example a weight of less than 0.65 g.

It may be that the seal comprises a repeating pattern of first and second regions. It may be that the seal comprises one first region for each cavity and one second region for each adjacent pair of blister packages.

Where used herein in connection with a dimension, "substantially constant" refers to a variation of less than two percent, for example less than one percent.

The present disclosure provides, according to a second aspect, a method of manufacturing a contact lens blister package assembly, for example of any other aspect.

It may be that the blister package assembly comprises at least two base members, each base member comprising a cavity holding a contact lens and contact lens packaging solution; and a (planar) surface region surrounding the cavity. It may be that the method comprises: affixing a seal member to each base member to form a seal and thereby contain the contact lens and the packaging solution in the cavity. It may be that the step of affixing comprises pressing the seal member against the base members, for example using a sealing head having a raised region. It may be that heating of the raised region melts the base member to form the seal. It may be that the raised region comprises a plurality of first raised regions, the first raised regions being spaced apart along the sealing head. It may be that the raised region comprises one or more second raised regions, each second raised region connecting (extending between) each pair of adjacent first raised regions. It may be that when the sealing head is pressing the seal member against the base member, each first raised region extends around a perimeter of the cavity on one of the base members. Using a sealing head with second raised regions may enable more precise control of the formation of the seal in the second seal regions/melt regions. It may be that the second raised region melts the thermoplastic material of the base member so as to provide a bridge of base member material between the previously separate base members. It will be appreciated that features of the shape or configuration of the seal and/or melt regions described above or below apply equally to the raised regions.

It may be that the first raised regions have a substantially constant width, wherein the width of the first raised region is the minimum perpendicular distance between the inner edge of the raised profile and an opposing outer edge of the raised region profile around the cavity; and wherein each second raised region extends along a first axis between the first raised regions of a pair; each second raised region has a length, being the minimum extent of the second raised region between the first raised regions, and a width, being the extent of the raised region in a direction perpendicular to the first axis, and wherein the length of the second raised region is at least a third of the minimum width of the second raised region.

The method may comprise placing a contact lens into the cavity of each base member, before affixing the seal member.

The method may comprise placing a volume of liquid contact lens packaging solution into the cavity of each base member, before affixing the seal member.

The method may comprise autoclaving the sealed contact lens blister package assembly to sterilize the contact lens and the packaging solution.

The step of affixing a seal member to the base member may comprise pressing the seal member against the base member, for example against the planar surface region. The step of affixing a seal member to the base member may comprise heating the seal member and base member to melt the seal member and the base member together to form the seal. It may be that said pressing and heating are carried out simultaneously. For example, the step of affixing may comprise melting a melt region of the seal member, while the seal member is pressed against the base member. For example, the step of affixing may comprise melting a region of a plastic layer of a (foil laminate) seal member and a (plastic) base member while the seal member is pressed against the base member. The method may comprise a sealing head (see below) pressing the seal member against the base member. It may be that a raised region of the sealing head presses the seal member against the base member. For example, it may be that the raised region is pressed against a surface of the seal member on the opposite side of the seal member to the base members of the assembly. It may be that the raised region is the only part of the sealing head that contacts the seal member.

The method may comprise the sealing surface and/or the raised region having a temperature of from 190 degrees Celsius to 285 degrees Celsius inclusive while pressed against the seal member. The method may comprise the sealing surface and/or the raised region exerting a pressure of from 45 PSI (0.3 MPa) to 85 PSI (0.6 MPa) inclusive on the seal member/base member, for example the planar surface region. The method may comprise pressing the seal member against the base member for a time of from 0.3 s to 2.5 s inclusive. The configuration of the seal can be adjusted by controlling the temperature of the sealing surface, the pressure applied to the seal member or the time for which the sealing surface presses the seal member against the base member.

In a further aspect of the disclosure, there is provide a sealing head for use in any other aspect. The sealing head may comprise a sealing surface having a raised region which, in use, is pressed against the blister package assembly. The sealing head, sealing surface and/or raised region may have any of the features described in connection with any other aspect. The sealing surface may comprise a planar surface region, for example the planar surface region may extend over the majority of the sealing surface. The sealing surface may comprise a raised region corresponding to the shape of the seal. It may be that the raised region is a protrusion on the planar sealing surface, the sealing head being configured to cause the seal member and/or base member to melt where the raised region presses against the blister package assembly. Thus, it may be that the shape of the raised regions defines the melt regions and/or seal regions. Use of the raised regions may assist in controlling the shape of the regions melted and thereby the seal. Thus, it will be appreciated that features of the shape or configuration of the seal and/or melt regions described above or below apply equally to the raised regions.

It may be that the raised region comprises a plurality of first raised regions. It may be that the first raised regions are spaced apart along the sealing head. It may be that the raised region comprises one or more second raised regions; each second raised region extending between each pair of adjacent first raised regions. It may be that each first region is spaced apart from any other first raised region.

In a further aspect, there is provided a blister package assembly comprising: at least two base members, each base member having a surface comprising a cavity containing a contact lens in a contact lens packaging solution, each base member being made of the thermoplastic material; and a seal member affixed to the surface of each base member to form a seal and thereby contain the contact lens and the packaging solution in the cavity. It may be that for each pair of adjacent base members, the seal member is fused to a melted region of the surface. It may be that said melted region extends between the base members of the pair to form one or more bridges of thermoplastic material. It may be that the sum of the minimum width of the bridge(s) is from 1 mm to 8 mm inclusive; and each bridge has a minimum length of 0.3 to 0.8 mm.

In a further aspect, there is provided a method of manufacturing a contact lens blister package assembly comprising a plurality of base members, each base member being made of thermoplastic material, comprising: a sealing head having a raised region heat sealing adjacent base members to a seal member, thereby forming a strip of interconnected blister packs each containing a contact lens in solution sealed within; and wherein the raised region comprises a bridge region that during heat sealing melts the thermoplastics material of the base members such that at least one bridge of the thermoplastics material extends between adjacent edges of the base members, partially along the length of the adjacent said edges, the or each bridge having a predetermined shape and size to thereby provide additional longitudinal rigidity to resist flexure of the strip of blister packs during packaging.

Thus, methods in accordance with the present aspect may control the formation of an elongate bridge between adjacent base members, in order to provide additional rigidity to the strip.

It may be that the method comprises further processing the strips of blister packs using secondary packaging machinery, including: moving and guiding the strips to form stacks of strips; and placing the stacks of strips into secondary packaging.

In a further aspect, there is provided a sealing head having a seal formation portion (for example a raised region) operable to heat seal adjacent base members of thermoformable plastics material to a seal member, thereby forming a strip of interconnected blister packs each containing a contact lens in solution sealed within; the sealing head further comprising a bridge shaping portion operable during the heat sealing operation to further thermoform at least one bridge of the plastics material across a gap between adjacent edges of the blister packs, the or each bridge having a predetermined size to thereby provide additional longitudinal rigidity to control flexure of the strip of blister packs.

In a further aspect, there is provided a strip of blister packs formed using the method of any other aspect of the sealing head of any other aspect. It may be that the or each bridge extends across the gap between the adjacent edges and for a predetermined distance partially along the length of the edges, and has a predetermined depth profile, the predetermined dimensions of the bridge being selected to thereby control flexure of the strip within desired limits during further processing by the secondary packaging machinery, whilst permitting separation of blisters by an end user without undue resistance.

With reference to FIG. 1 to 5, in accordance with a first example embodiment, a blister package strip 1 comprises five blister packages 2. Each blister package 2 has a base member 4 having a planar top surface 6 surrounding the perimeter 34 of a cavity 8. In use, an unworn contact lens (not shown) is stored in the cavity 8 in a contact lens packaging solution (not shown). A seal member 10 (see FIG. 4) is affixed to the planar top surface 6 of each base member 4 of the strip 1 to form a seal 12. The seal 12 comprises a plurality of first seal regions 14, each first seal region 14 extending around the perimeter of a cavity 8 having a centre 42. The seal 12 also comprises a plurality of second seal regions 16, each second seal region 16 interconnecting the first seal regions 14, and across the side 9 (see FIG. 3) of the base member closest the adjacent base member. Each second seal region 16 extends along a first axis 18, shown with a dashed line in FIG. 1, which extends between the cavities 8 at the point where the cavities 8 are closest together. In embodiments, the seal member 10 is affixed to the base members 4 by melting a melt region 13 (see FIG. 4) of the seal member 10 to form the seal 12. Thus, the melt region 13 comprises first melt regions 15 corresponding to the first seal regions 14. The melt region 13 also comprises second melt regions 17 corresponding to the second seal regions 16.

Around the cavity, the seal 12 comprises an arc 20 of constant radius, with a straight line 22 tangent to the arc at each end, the straight lines 22 meeting at a point 24. Each blister package 2 at the end of the strip has a single second seal region 16 extending towards the adjacent blister package 2. Where a blister package 2 has blister packages on either side, the blister package has two second seal regions 16, one extending towards each of the adjacent blister packages 2. The shape of the first seal region 14 and second seal regions 16 is substantially identical on each blister package. Thus, the seal 12 comprises a repeating pattern of first and second seal regions 14, 16. Similarly, the seal member 10 comprises a repeating pattern of first and second melt regions 15, 17.

Figure 3:
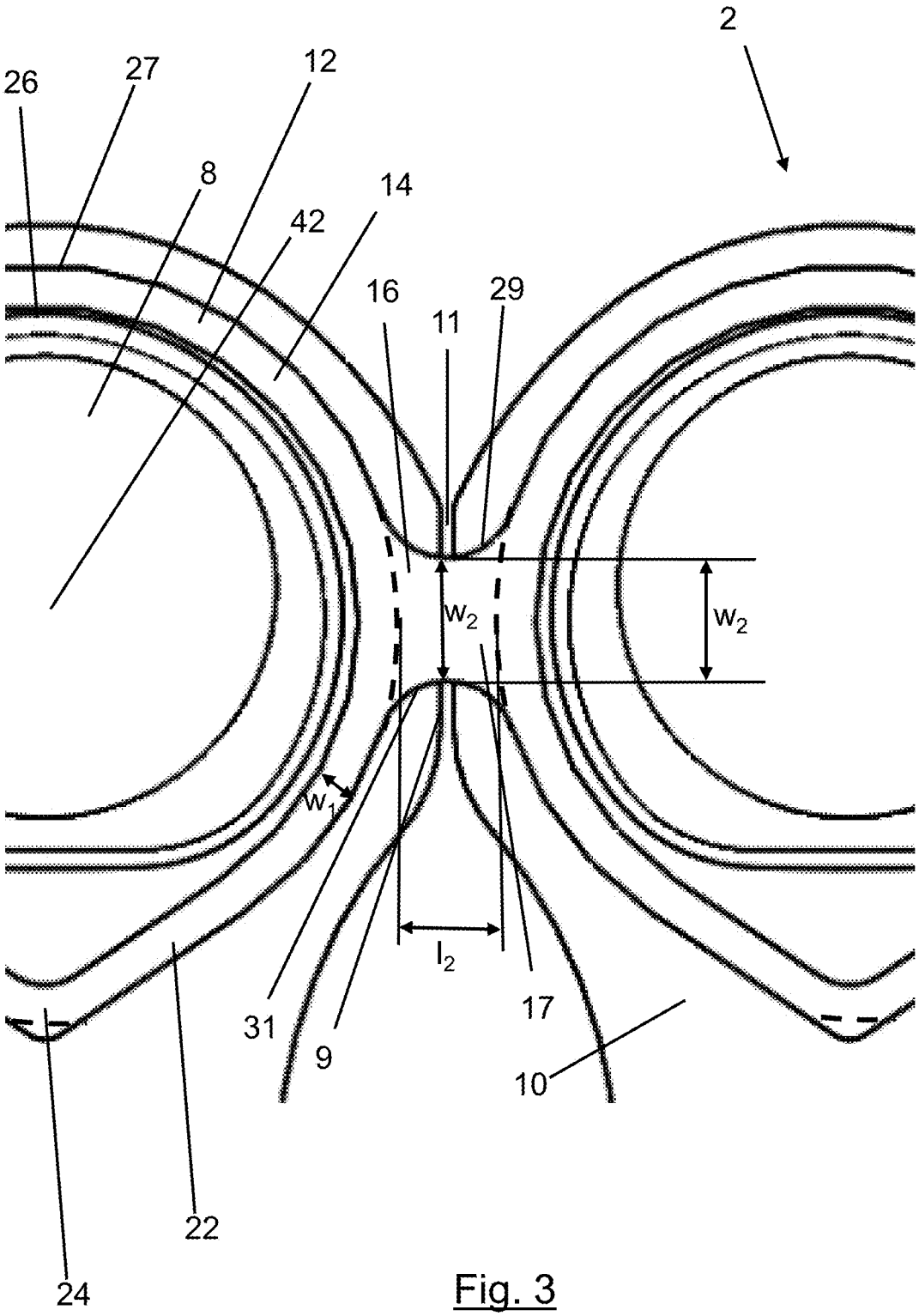
FIG. 3 shows a close-up plan view of the blister package strip 1 of FIG. 1.
Figure 4:
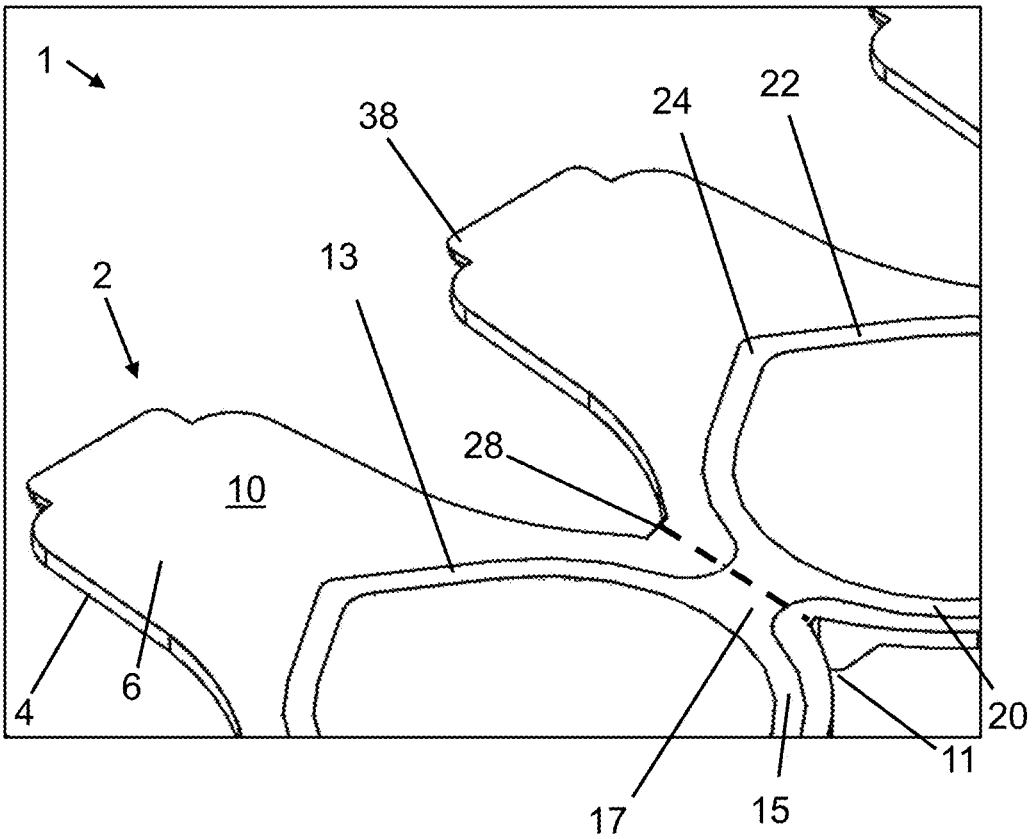
FIG. 4 shows a close-up perspective view of the blister package strip of FIG. 1 with the seal member 10 in place, for the sake of understanding the melt region is shown on top of the seal member 10, but it will be appreciated that this is not its location in reality.
Figure 5:
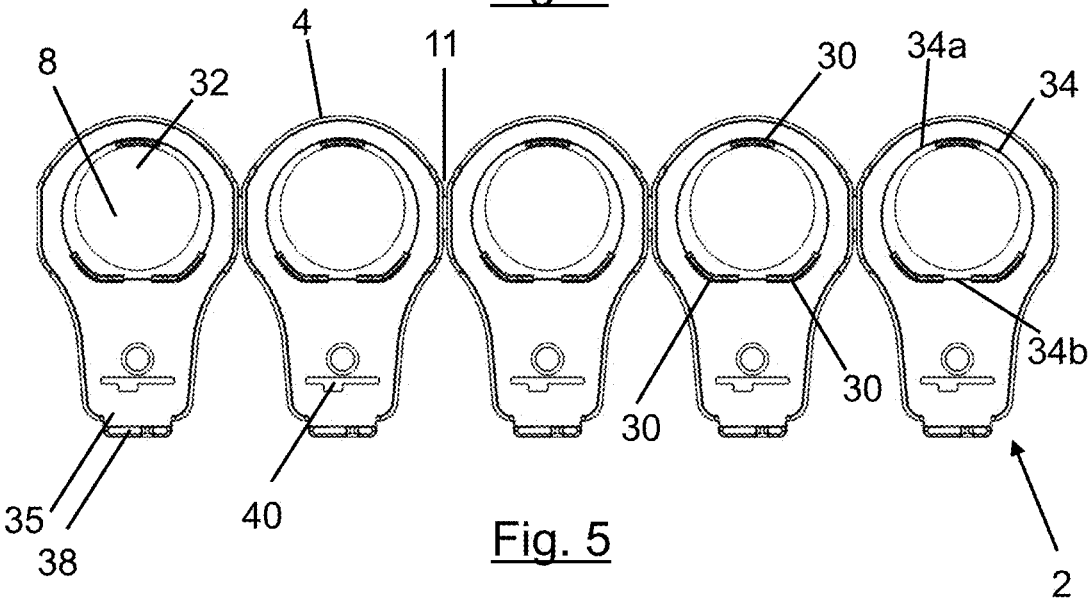
FIG. 5 shows a plan view of the bottom of the blister package strip 1 of FIG. 1.

As shown in more detail in the close-up view of FIG. 3, the seal 12 has a minimum distance between its inner edge 26 and outer edge 27 at the 12 o'clock position. This sets the width '$w_1$' of the first seal region 14/first melt region 15 (i.e. '$w_1$' is equal to the minimum distance), the extent of which is shown in dashed lines in FIG. 3 where it does not align with the outer edge of the seal. The point 24, the radial extent is greater than '$w_1$', and so, some of the seal 12 lies outside the first seal region 14/first melt region 15. A second seal region 16 between the first seal regions 14 and has a length $l_2$ and a width $w_2$ between the upper 29 and lower 31 edges of the seal 12. In embodiments, $l_2$ is 3.5 mm and $w_2$ is 5 mm. In FIG. 3, the minimum width of the second seal region 16 is midway between the first seal regions 14. The base members 4 are spaced apart along the seal member 10 so that a gap 11 is formed between each pair of adjacent blister packages, the second seal region 16 extends over that gap. As shown in FIG. 4, a line of perforations 28 extends through the seal member 10, second melt region 17 and second seal regions 16 perpendicular to the length of the second seal region 16 along the gap 11. It may be that the thickness of the thermoplastic material in the gap (i.e. the melt depth) is at least 0.5 mm.

The base 32 of the cavity 8 is circular when viewed in plan, but the perimeter 34 of the cavity 8 where it intersects the planar top surface 6 comprises an arc **34*a* closed off by a flat edge 34*b* along the side nearest the point 24 of the seal 12. Each base member has three legs 30 extending from the underside of the base member 4 (i.e. the opposite side of the base member 4 to the top surface 6) at the perimeter 34 of the cavity 8. Each base member has a side tab 37, located on each side 9. At a first end 35 (being the end furthest from the cavity 8) the base member 4 comprises a tab 38. A through-hole 40 extends through the base member 4. The tab 38 and through-hole 40 are shaped and configured so that in the case of first, second and third identical blister packages, the tab 38 of the second blister package can be received in the through-hole 40 of the first blister package while the tab of the third blister package is received in the through-hole 40** of the second blister package, such that the first, second and third blister packages are mechanically fastened together.

Without wishing to be bound by theory, it is believed that the presence of the second seal regions 16 and/or second melt regions 17 can reduce drooping of the blister strip by providing additional rigidity along the first axis. This may make the blister strip easier to handle during subsequent manufacturing steps (e.g. when placing the strip in the autoclave) and/or packaging steps (e.g. when placing the strip in a carton). Additionally or alternatively, this additional rigidity is provided without increasing the amount of plastics material in the base member and/or without making the seal member harder to remove (e.g. be increasing the area of the seal).

Figure 6:
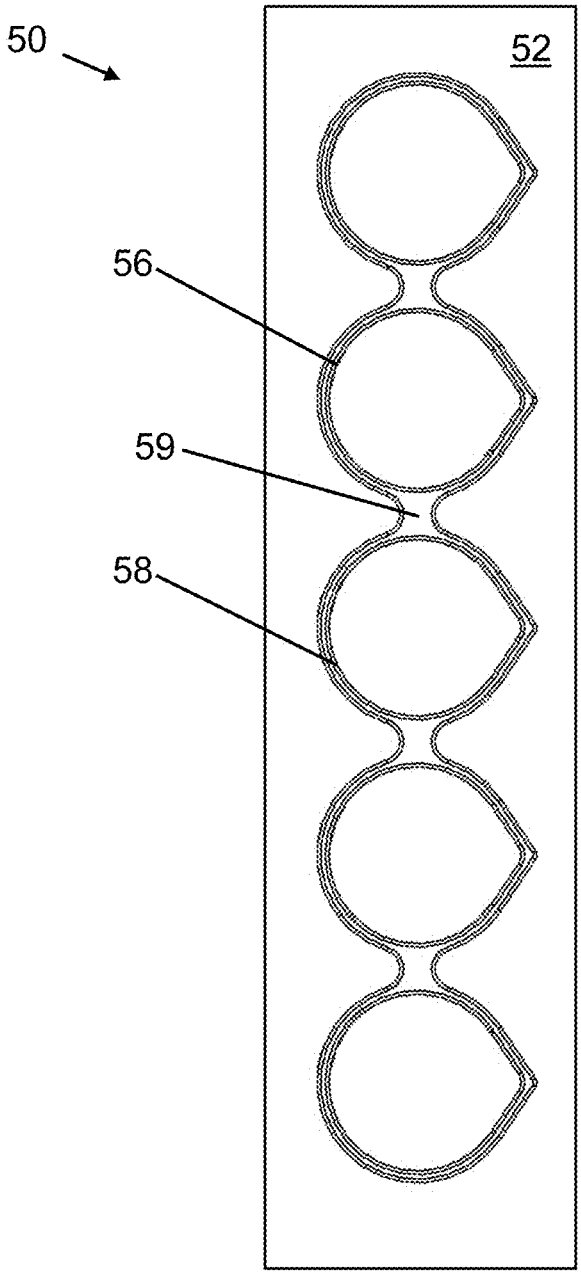
FIG. 6 shows a plan view of a sealing head for use in manufacturing the blister package strip 1 of FIG. 1.

FIG. 6 shows a plan view of a sealing head 50 for use in manufacturing the blister package strip 1 of the first embodiment. The sealing head 50 comprises a planar sealing surface 52 having formed thereon a ridge or raised region 56, each raised region 56 comprises first raised regions 58 corresponding to the first seal regions 14 and second raised regions 59 corresponding to the second seal regions 16.

Figure 7:
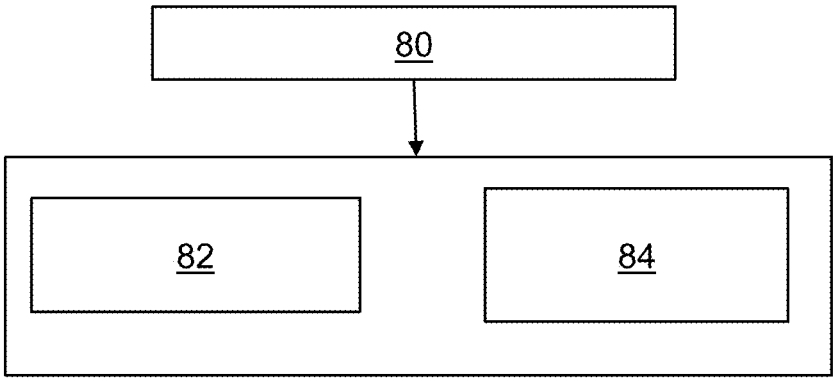
FIG. 7 shows an example method of manufacturing a blister package strip in accordance with the present disclosure.

FIG. 7 shows a flow chart of an example method in accordance with the present disclosure. The method comprises placing 80 a seal member on top of a plurality of blister packages arranged in a row. The method comprises pressing 82 the seal member onto the blister packages using a sealing head and/or heating 84 regions of the seal member using the sealing head to form a seal between the blister packages and the seal member, the seal having a plurality of first regions and a plurality of second regions as described above. Additionally of alternatively, the method comprises pressing the seal member onto the blister packages using a sealing head and/or heating regions of the seal member using the sealing head to provide a seal by melting a melt region on the seal member, the melt region having a plurality of first melt regions and a plurality of second melt regions as described above.

Figure 8:
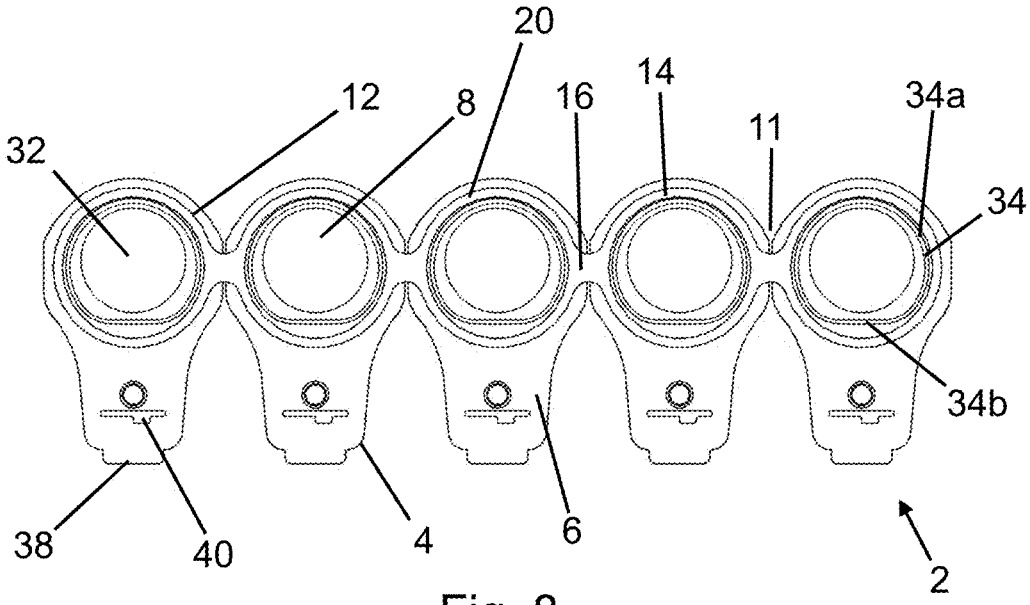
FIG. 8 shows a plan view of the top of a blister package strip 1 in accordance with a second example embodiment.

FIG. 8 shows a second example embodiment. Like reference numerals indicate like elements as between the first and second example embodiment. Only those aspects of the second embodiment which differ from the first embodiment will be described here. In the second embodiment, the seal 12 around the cavity 8 is annular, rather than having a point 24.

Whilst the present disclosure has been described and illustrated with reference to particular embodiments, it will be appreciated by those of ordinary skill in the art that the disclosure lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as preferable, advantageous, convenient or the like are optional and do not limit the scope of the independent claims. Moreover, it is to be understood that such optional integers or features, whilst of possible benefit in some embodiments of the disclosure, may not be desirable, and may therefore be absent, in other embodiments.

The invention claimed is:

1. A blister package assembly comprising:

at least two base members separate from one another, each base member comprising (i) a cavity containing a contact lens in a contact lens packaging solution and (ii) a planar surface region surrounding the cavity; and a seal member affixed to the planar surface region of each base member to form a seal and thereby contain the contact lens and the packaging solution in the cavity;

wherein for each pair of adjacent base members, the seal comprises:

for each base member, a first seal region extending around the whole of the perimeter of the cavity and extending from an inner edge of the seal, the first seal region having a substantially constant width, wherein the width of the first seal region is the minimum perpendicular distance between the inner edge of the seal and an opposing outer edge of the seal around the cavity, the first seal regions of the pair being spaced apart; and at least one second seal region, each second seal region interconnecting the first seal regions of the pair along a first axis;

the each second seal region having a length, being the minimum extent of the second seal region between the first seal regions in a direction parallel to the first axis, and a width, being the extent of the seal in a direction perpendicular to the first axis, and wherein the length of the second seal region is at least a third of the minimum width of the second seal region.

2. The blister package assembly according to claim 1, wherein for each pair of adjacent base members a single second seal region extends between the first seal regions of the pair.

3. The blister package assembly according to claim 2, wherein the first axis extends between the first seal regions of the pair where the distance between the outer edges of the first seal regions of the pair is at a minimum.

4. The blister package assembly according to claim 1, wherein each first seal region has substantially the same width as any other first seal region of the assembly; and/or each second seal region has substantially the same minimum width as any other second seal region of the assembly.

5. The blister package assembly according to claim 1, wherein each of the first seal regions has a width of from 1 mm to 2 mm inclusive.

6. The blister package assembly according to claim 1, wherein each of the second seal regions has a minimum width of from 1 mm to 8 mm inclusive.

7. The blister package assembly according to claim 1, wherein each second seal region has a length of at least 2 mm.

8. The blister package assembly according to claim 1, wherein, for each base member, the seal member comprises a pull tab, being a region of the seal member that is not affixed to the base member by the seal, wherein the pull tab is sized and configured to be held between the thumb and forefinger of a user, the base member and the pull tab being configured such that the user pulls the pull tab along a first pull-axis in order to remove the seal member from the base member and wherein the pull-axis is perpendicular to the first axis along which the or each second seal region extends.

9. The blister package assembly according to claim 8, wherein each base member has a first end, being the end of the base member furthest from the centre of the cavity, and the pull tab extends from the edge of the seal closest to the first end towards to the first end.

10. The blister package assembly according to claim 1, wherein for each pair of adjacent blister packages, the seal member comprises a series of perforations extending perpendicular to the first axis(es) and being equidistant from the first seal regions of the pair.

11. The blister package assembly according to claim 1, wherein each first seal region comprises an arcuate region extending over an angle of at least 180 degrees around the centre of the cavity.

12. The blister package assembly according to claim 11, wherein each first seal region is an annulus that is concentric with the cavity.

13. The blister package assembly according to claim 11, wherein each first seal region comprises two straight regions, one straight region being a tangent to the curvature of the first seal region at a first end of the arcuate region and the other straight region being a tangent to the curvature of the first seal region at a second end of the arcuate region, and wherein the two straight regions meet such that the first seal region extends around the perimeter of the cavity.

14. The blister package assembly according to claim 1, wherein each base member is made of a plastics material, and/or the seal member comprises a layer of plastics material and a layer of foil.

15. The blister package assembly according to claim 1, wherein the seal member is fused to the base member at the seal.

16. The blister package assembly according to claim 1, comprising at least five base members arranged in a row along the longitudinal axis of the seal member.

17. The blister package assembly according to claim 1, having a gap between the base members of each pair of adjacent blister packages.

18. A method of manufacturing a blister package assembly of claim 1, the method comprising: affixing the seal member to each of the at least two base members to form the seal and thereby contain the contact lens and the packaging solution in the cavity, wherein the step of affixing comprises pressing the seal member against the at least two base members using a sealing head having a raised region, wherein heating of the raised region melts the at least two base members to form the seal, the raised region comprising:

a plurality of first raised regions, the first raised regions being spaced apart along the sealing head; and one or more second raised regions, each second raised region interconnecting each pair of adjacent first raised regions; and wherein when the sealing head is pressing the seal member against each of the at least two base members, each first raised region extends around the whole of the perimeter of the cavity on one of the at least two base members.

19. The method according to claim 18, wherein the first raised regions have a substantially constant width, wherein the width of the first raised region is the minimum perpendicular distance between the inner edge of the raised profile and an opposing outer edge of the raised region profile around the cavity; and wherein each second raised region extends along a first axis between the first raised regions of a pair;

each second raised region has a length, being the minimum extent of the second raised region between the first raised regions, and a width, being the extent of the raised region in a direction perpendicular to the first axis, and wherein the length of the second raised region is at least a third of the minimum width of the second raised region.

20. A blister package assembly comprising:

at least two base members, each base member having a surface comprising a cavity containing a contact lens in a contact lens packaging solution, each base member being made of the thermoplastic material; and a seal member affixed to the surface of each base member to form a seal and thereby contain the contact lens and the packaging solution in the cavity;

wherein for each pair of adjacent base members, the seal member is fused to a melted region of the surface; said melted region extends between the base members of the pair as one or more bridges of thermoplastic material extending between the base members of the pair, each of said one or more bridges having a minimum width; and wherein the sum of the minimum widths of said one or more bridges is from 1 mm to 8 mm inclusive; and each of said one or more bridges has a minimum length of 0.3 to 0.8 mm.

21. A method of manufacturing a blister package assembly of claim 20, comprising:

heat sealing adjacent base members of the at least two base members to the seal member by a sealing head having a raised region, thereby forming a strip of interconnected blister packs each containing the contact lens in the contact lens packaging solution sealed within; and wherein the raised region comprises a bridge region that during heat sealing melts the thermoplastics material of the base members such that at least one bridge of the thermoplastics material extends between adjacent edges of the base members, partially along the length of the adjacent said edges, the or each bridge having a predetermined shape and size to thereby provide additional longitudinal rigidity to resist flexure of the strip of blister packs during packaging.

22. The method of claim 21, comprising further processing the strips of blister packs using secondary packaging machinery, including:

moving and guiding the strips to form stacks of strips; and placing the stacks of strips into secondary packaging.

23. The blister package assembly of claim 20, comprising a strip of blister packs, wherein each of said one or more bridges extends across a gap between adjacent edges and for a predetermined distance partially along a length of the edges, and has a predetermined depth profile, the predetermined dimensions of the bridge being selected to thereby control flexure of the strip within desired limits during further processing by secondary packaging machinery, whilst permitting separation of blisters by an end user without undue resistance.

* * * * *